United States Patent [19]

Borel

[11] Patent Number: 4,564,052

[45] Date of Patent: Jan. 14, 1986

[54] DOUBLE-LAYER FABRIC FOR PAPER MACHINE SCREEN

[75] Inventor: Georg Borel, Reutlingen, Fed. Rep. of Germany

[73] Assignee: Hermann Wangner GmbH & Co. KG, Fed. Rep. of Germany

[21] Appl. No.: 676,208

[22] Filed: Nov. 28, 1984

Related U.S. Application Data

[63] Continuation of Ser. No. 443,053, Nov. 19, 1982, abandoned.

[30] Foreign Application Priority Data

Nov. 23, 1981 [DE] Fed. Rep. of Germany ..... 3146385

[51] Int. Cl.[4] ..... D03D 15/00; D21F 1/10

[52] U.S. Cl. ..... 139/425 A; 139/383 A; 139/414; 162/DIG. 1; 162/348

[58] Field of Search ..... 139/425 A, 383 A, 408–414; 162/DIG. 1, 348, 358; 245/2.8; 428/255, 257

[56] References Cited

U.S. PATENT DOCUMENTS

| | | | |
|---|---|---|---|
| 653,595 | 7/1900 | Stevenson | 139/414 |
| 3,382,979 | 5/1968 | Helland et al. | 139/383 A |
| 3,383,278 | 5/1968 | Helland | 139/425 A |
| 4,041,989 | 8/1977 | Johansson et al. . | |
| 4,071,050 | 1/1978 | Codorniu . | |
| 4,086,941 | 5/1978 | Thompson | 139/383 A |
| 4,112,982 | 9/1978 | Bugge et al. | 139/425 A |
| 4,171,009 | 10/1979 | Karm . | |
| 4,314,589 | 2/1982 | Buchanan et al. | 139/383 A |
| 4,356,844 | 11/1982 | Thompson | 139/383 A |
| 4,359,069 | 11/1982 | Hahn | 139/383 A |

FOREIGN PATENT DOCUMENTS

| | | | |
|---|---|---|---|
| 530871 | 8/1954 | Belgium | 139/425 A |
| 0048962 | 4/1982 | European Pat. Off. | 139/383 A |
| 454092 | 12/1927 | Fed. Rep. of Germany | 139/383 A |
| 1843900 | 12/1961 | Fed. Rep. of Germany . | |
| 7630822 | 3/1977 | Fed. Rep. of Germany . | |
| 2747160 | 4/1978 | Fed. Rep. of Germany . | |
| 2907488 | 8/1980 | Fed. Rep. of Germany | 139/425 A |
| 7702520 | 11/1978 | Sweden . | |
| 964791 | 7/1964 | United Kingdom . | |

*Primary Examiner*—James Kee Chi

*Attorney, Agent, or Firm*—John J. Torrente

[57] ABSTRACT

A double-layer woven fabric comprising longitudinally extending warp wires and two layers of transversely extending weft wires, at least part of the warp wires being interwoven with weft wires of both weft layers and warp wires, separated by not more than one intermediate warp wire, extending pair-wise in parallel at least over part of their length on the paper side and/or on the running side of the fabric.

3 Claims, 18 Drawing Figures

DOUBLE-LAYER FABRIC FOR PAPER MACHINE SCREEN

This application is a continuation of application Ser. No. 443,053, filed Nov. 19, 1982, now abandoned.

BACKGROUND OF THE INVENTION

This invention relates to a double-layer fabric for use as a screen in the sheet forming and drying sections of a papermachine. In particular, it relates to a double-layer fabric which includes two layers of transversely extending weft wires and longitudinally extending warp wires at least part of which are interwoven with both layers of the weft wires.

Synthetic fabrics for use in papermachines have been in a state of constant development ever since such fabrics were first proposed as replacements for metal screens. Synthetic fabrics are used in the sheet forming section of papermachines and are also useable in the drying section of such machines. Initial fabrics were of single-layer weaves, but later fabrics incorporated double-layer weaves to achieve better stability and retention. However, even with the double-layer weaves, marking of the paper web and high abrasion were found to occur, especially when the fabric was used in the wet end of the sheet forming section of the papermachine.

German OS No. 2,263,476 discloses a monoplanar fabric in which the warp and weft knuckles are disposed in one plane after setting. In the disclosed fabric, the warp wire passes at least twice over a crossing wire of the top weft layer. However, with this fabric, due to the groove-like recesses in diagonal direction between the groups of warp and weft knuckles, marking was still very considerable and could not be eliminated even by grinding on the paper side. Moreover, the fact that the warp bend extended below two weft pairs on the running side made the fabric subject to very rapid wear.

In order to avoid these shortcomings, German OS No. 2,540,490 proposes to pass the warp wire under only a single weft wire on the running side. This enables the free weft bend to become longer, and, at high setting tension, the warp wire can be embedded deeper into the fabric interior. However, the increased life realizable with this technique is limited, since only relatively thin weft wires can be interwoven on the running side. If other than thin weft wires were used, the warp wire could not sufficiently deform the thicker and stiffer weft wire and consequently it would remain on the external side of the fabric.

German OS No. 2,706,235 and Swedish AS No. 7,702,520-3 also deal with double-layer papermachine fabrics and disclose passing the warp wires around only a single weft wire on the paper side. The resultant fabric has a symmetrical weave pattern on the paper and running sides and exhibits high permeability. The long weft bends leave strong marks, so that the screen cannot be used to manufacture paper susceptible to marking.

While, in the above-mentioned papermachine screens, the paper side of the fabric is formed mainly by the weft wires, German Utility Model No. 7,630,822 discloses forming the paper side predominantly from warp wires. In this fabric, the warp wires are disposed above the weft wires in the top layer. Since the paper pulp is likewise oriented in longitudinal direction, resultant problems in sheet removal can be encountered with this fabric.

It is therefore an object of the present invention to develop a double-layer fabric for use as papermachine screen which can be used for the manufacture of paper susceptible to marking and which exhibits good retention and has a long lifetime.

SUMMARY OF THE INVENTION

In accordance with the principles of the present invention, the above and other objectives are realized in a double-layer fabric of the above-mentioned type in which warp wires separated by no more than one intermediate warp wire are guided pair-wise in parallel at least over part of their length on the paper side and/or on the running side of the fabric.

The fact that the double-layer fabric of the invention is found to cause only slight marking is believed to be due to the fact that the fibers of the paper web are supported by a planar structure formed by the parallelly guided adjacent warp wires, rather than by individual bends of the wires, especially when the warp wires pass in parallel over two or more weft wires of the top weft layer. Passing the warp wires in parallel along at least part of their length implies that they rise to the screen top in front of the same weft wire and they descend from the screen top together behind the same weft wire.

In the known double-layer fabrics, marking is more intense because the surface consists of numerous individual knuckles of the warp or weft wires which leave relatively deep impressions in the easily deformable paper pulp. These impressions are regularly distributed corresponding to the weave pattern and thus become a visible fabric marking, although the individual impressions are hardly perceptible. The impressions caused by warp or weft knuckles are especially deep when the knuckles are surrounded by open meshes.

In the fabric of the invention the planar support of the paper pulp is preferably provided by directly adjacent warp wires, rather than by weft wires, because the density of the warp wires in a double-layer fabric is normally three times as high as the density of the weft wires. It, therefore, is difficult to push two successive weft wires close enough together so that they form a nearly closed surface for the paper pulp. With the warp wires this problem does not arise because the wire filling ratio usually exceeds 100 percent. The filling ratio is defined as follows: filling ratio = number of warp wires/centimeter × warp wire diameter (in cm) × 100. On account of the very high filling ratio of double-layer fabrics, not only directly adjacent warp wires, but warp wires separated by not more than one intermediate warp wire may be used to form the supporting platform.

The fabric of the invention can be further improved by causing the paper side of the fabric to produce two types of markings, namely, firstly, a planar marking formed by the warp wires passing in parallel along part of their length, and secondly, the individual wire markings caused by the knuckles of individual weft wires. By alternating these two types of marks, they interrupt the regularity of the marking pattern, which results in an overall reduction in the perceptible marking.

BRIEF DESCRIPTION OF THE DRAWINGS

The above and other features and aspects of the present invention will become more apparent upon reading the following detailed description in conjunction with the accompanying drawings, in which.

It should be noted that the drawings show flat-woven fabrics wherein the warp wires extend in papermachine direction and the weft wires extend in the cross-machine direction. However, the invention is applicable also to endless or circularly woven fabrics in which case the terms "warp wires" and "weft wires" have to be interchanged. Hereinafter "warp wires" are to be understood exculsively as the wires extending in machine direction and "weft wires" as the wires extending in cross-machine direction.

DETAILED DESCRIPTION

Figure 1:
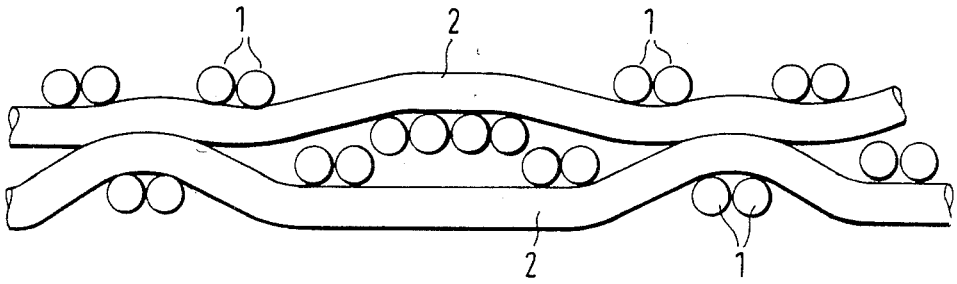
FIG. 1 shows a double-layer fabric in which the warp wires are passed pair-wise in parallel in both weft layers.

FIG. 1 shows a double-layer fabric or screen in accordance with the principles of the present invention. The fabric comprises warp wires 1 which are passed in pairs along their entire length so that they are disposed parallel side by side in pairs on the paper side as well as on the running side of the fabric. The desired planar support of the paper pulp is achieved in that each pair of warp wires passes over at least two weft wires 2 of the top weft layer. The pair-wise guidance of the warp wires results, on the running-side of the fabric, in twice as long floats of the weft wire 2 with predetermined warp wire density, without the need of doubling the harness number of the weaving machine. In this embodiment, the weft wire 2 may also be crimped more because the arrangement of the warp wires 1 in pairs side by side allows the use of substantially thicker weft wires 2 in the bottom layer.

In single-layer papermachine fabrics, there is no advantage in passing the warp wires through the fabric in pairs. Although an altogether thinner and more flexible papermachine fabric can be obtained owing to the distribution of the warp wire cross section over a plurality of wires, the open area decreases in cross-machine direction. Also, the reduction of the warp wire diameter makes the fabrics highly prone to abrasion although the overall cross section of the warp remains substantially the same.

In the double-layer fabric of the invention illustrated in FIG. 1, however, the warp wires have not been developed by distributing an original wire cross section over several wires. In particular, the warp wires 1 have a thickness which is the same as that in a fabric of otherwise equal construction, and only the course of the warp wires has been varied so that a double warp is obtained.

Furthermore, while in single-layer papermachine fabrics with double warp weaving, the warp wires are substantially thinner than the weft wires and may have even only half the weft wire diameter, in the FIG. 1 embodiment, the weft wires 2 and the warp wires 1 have about equal diameter. As is generally customary, the diameter of the warp wires may be about 10% less than that of the weft wires.

Figure 2:
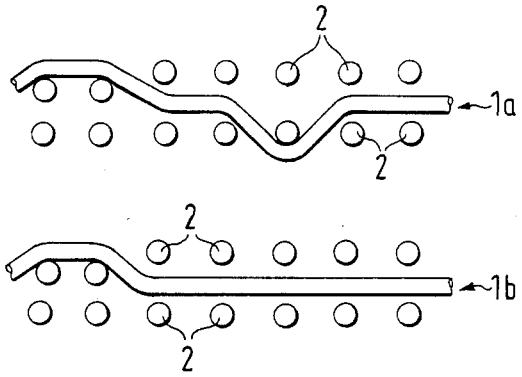
FIG. 2 shows a double-layer fabric in which two adjacent warp wires are passed in parallel only on the top weft layer side, and only one of each pair of warp wires is also woven into the bottom weft layer, said figure showing the course of both warp wires.

In the embodiment of the invention shown in FIG. 2, the warp wires 1*a*, 1*b* extend pair-wise in parallel only on the fabric top side. The course of one of the warp wires of a pair is shown in the upper illustration of FIG. 2 and the course of the other warp wire of the same pair is shown in the lower illustration of FIG. 2. It is apparent from these figures that only the warp wire 1*a* is woven into the bottom weft layer, while the other warp wire 1*b* continues its course in the fabric interior so that it is not subject to any wear. In this fabric construction, the free float length of the weft wires 2 on the running side of the fabric is doubled, but weaving calls for twice the number of harnesses than weaving of the fabric shown in FIG. 1, and requires two warp beams.

Figure 3:
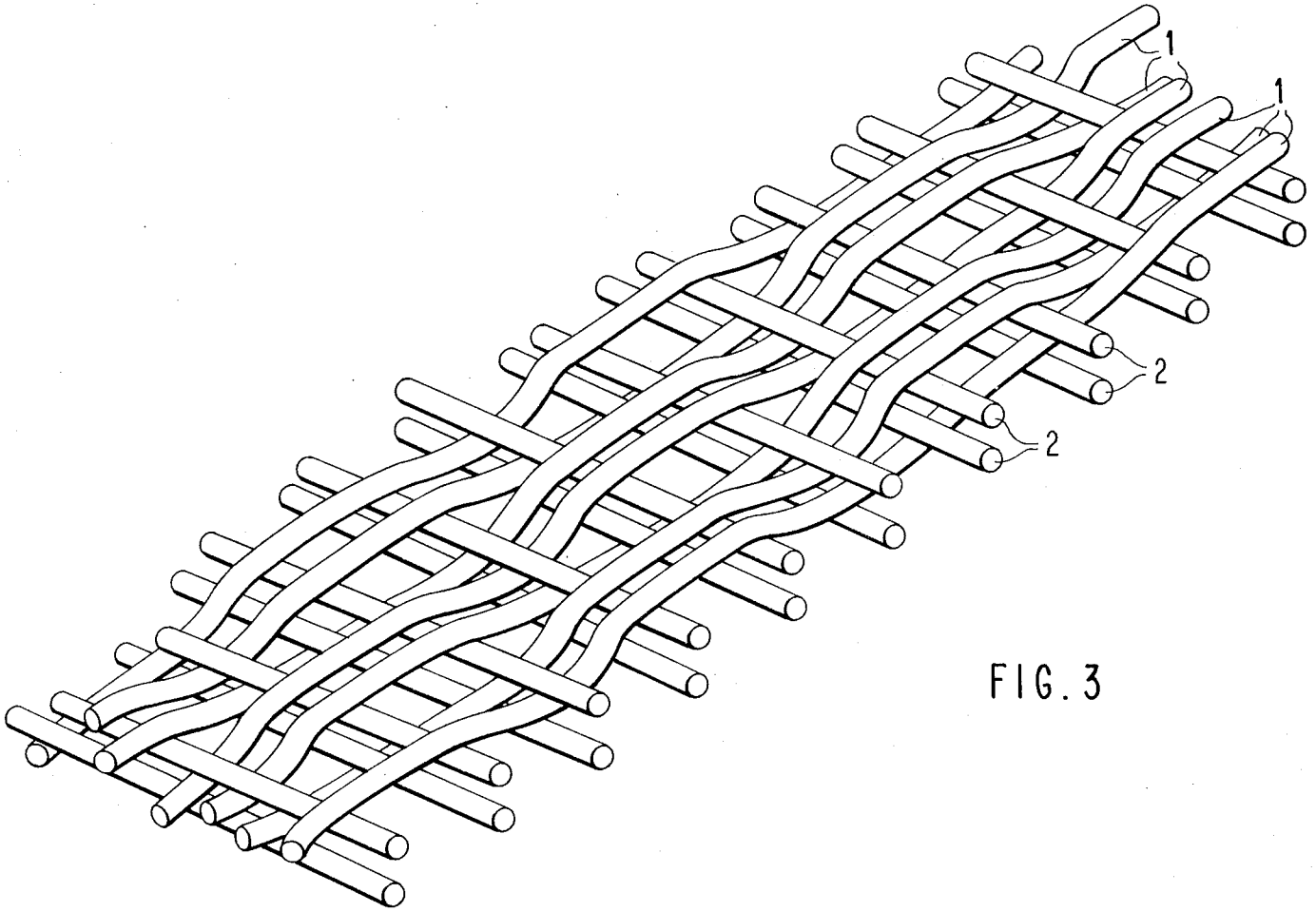
FIG. 3 illustrates the top side of a further embodiment of the double-layer fabric of the invention.

FIG. 3 illustrates a further embodiment of a fabric incorporating the principles of the present invention. In this embodiment, the warp wires 1 are passed so that they take part in forming the supporting surfaces on the paper side twice in each repeat: the first time together with the preceding warp wire, the second time with the next following warp wire. This embodiment is advantageous over the embodiments shown in FIGS. 1 and 2 in that adjacent warp wires 1 no longer extend in parallel but at a considerable angle with respect to each other in the fabric interior. This opens the fabric in the oblique or transverse direction and thus makes it more permeable in its interior.

Figure 4:
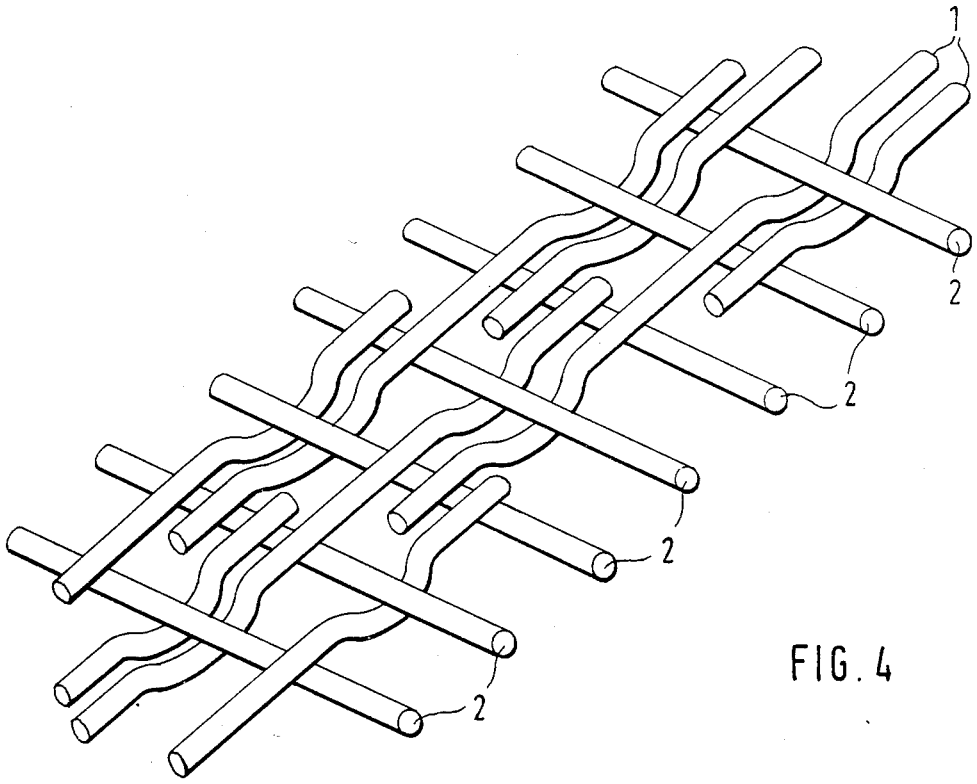
FIG. 4 illustrates the bottom layer (viewed from top) of a double-layer fabric of the invention.

FIG. 4 is a top view of the bottom layer of the fabric of the invention and shows how by pair-wise crimping of the warp wires 1 about the lower weft wires 2 better (more intensive) crimping of the weft wires is achieved. In FIG. 4, each warp wire 1 together with the preceding warp wire is crimped about a certain weft wire 2, i.e. it extends below a weft wire. Thereafter, it crosses two weft wires in the fabric interior, i.e. it passes over two weft wires, and then it is again crimped together with the next following warp wire under a third weft wire. Of course, the warp wires can extend in the fabric interior over more than two weft wires. Regardless of the binding in the top layer, this pair-wise crimping of the warp wires in the bottom layer effects more intense crimping of the weft wires and thus prolongs the lifetime of the fabric.

Figure 5:
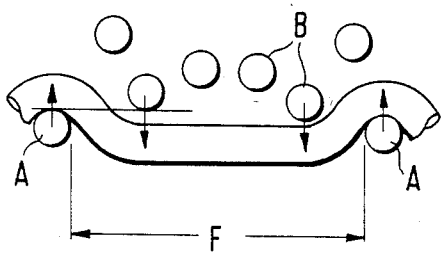
FIG. 5 illustrates the individual forces exerted on a weft wire in the bottom weft layer which result in crimping thereof.

FIG. 5 explains the influences that determine the crimping of the weft wires on the running side of the fabric. The object is to crimp the weft wires 2 so that they are disposed lower than the warp wires and are worn through before the warp wires 1. With a given warp wire thickness a weft wire crimps more intensely, firstly, the longer the free float F; secondly, the greater the force with which the externally disposed warp wires A exert pressure on the weft wire; and thirdly, the greater the force exerted in downward direction by the internally extending warp wires B.

The following may be said about these three influences. The length of free float is defined by the harness number of the binding and is thus predetermined so that in a selected binding the intensity of the crimp is influenced by the forces exerted by the externally and the internally disposed warp wires. The external warp wires A must be strong enough (large diameter) to form the short weft bend. In the embodiment of FIG. 4 this is achieved in that two adjacent warp wires cooperate in the crimping. The downwardly directed force exerted by the interiorly disposed warp wires B can be increased in that per repeat each warp wire is passed at least about two not directly successive weft wires on the running side. While in conventional bindings the warp is passed upwardly to the top layer after passing around a weft wire on the running side, in the fabric of FIG. 4 the warp wire is passed around a further weft wire before being again woven into the top layer.

Figure 6:
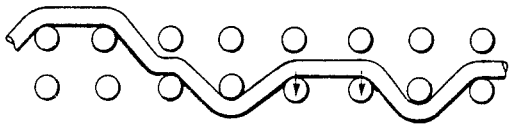
FIG. 6 shows the course of the warp wire and the weft wire in the bottom layer of a double-layer fabric of the invention.

FIG. 6 shows in the upper illustration the binding of each warp wire into two weft wires of the bottom layer per repeat. The lower illustration of FIG. 6 shows the assembly of two warp wires to form a weft wire band.

It is a further advantage of the fabric of the invention that in the fabric interior there are relatively few parallelly extending warp wires, i.e. most of the warp wires extend at an angle with respect to one another in the fabric interior. This avoids clogging in the interior and increases the draining capacity of the fabric. The effect of this measure increases as the number of harnesses used to form the binding increases.

EXAMPLE 1

The fabric comprises two plies, and in the final state it includes 62 longitudinal wires per centimeter (warp wires in flat-woven fabrics, weft wires in circularly woven fabrics) of polyester monofilaments having a wire diameter of 0.17 mm.

The transverse wires disposed in pairs one above the other are likewise monofilaments. The fabric has altogether 2×23 transverse wires; 23 in the top layer and 23 in the bottom layer. The transverse wires of the top layer are all made from polyester and have a diameter of 0.17 mm. In the bottom layer polyester and polyamide wires are alternately interwoven, both of a diameter of 0.18 mm.

The fabric weave is an 8-harness weave. The longitudinal wires are passed over two transverse wires each on the paper side. The desired planar structure is ensured by the parallel course of two successive longitudinal wires along part of their length.

Figure 7A:
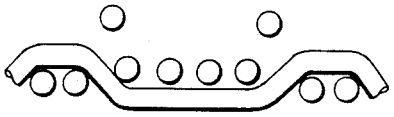
FIG. 7A shows in schematic fashion the weave pattern on the paper side of a double-layer fabric in accordance with the principles of the invention.
Figure 7A:
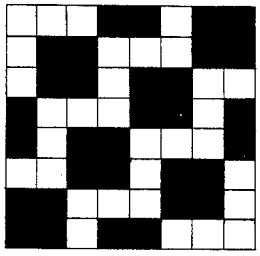

FIG. 7A shows the weave on the paper side.

Figure 7B:
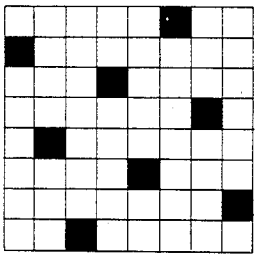
FIG. 7B illustrates in schematic fashion the weave pattern on the running side of the double-layer fabric of FIG. 7A.

FIG. 7B shows the weave on the running side.

Figure 7C:
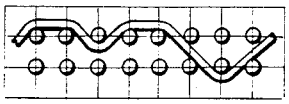
FIG. 7C illustrates the course of a longitudinal wire in the double-layer fabric of FIGS. 7A and 7B.

FIG. 7C shows the course of a longitudinal wire.

The longitudinal wires extend in pairs only on the paper side so that a fabric with a planar top side and conventional running side is obtained.

EXAMPLE 2

The fabric uses longitudinal wires of the same type as in Example 1 but woven in a different manner. On the running side successive longitudinal wires are joined by two-fold interweaving over part of their length. On the paper side they are interwoven only once. This results in a conventional paper side and in an underside with more intensely crimped transverse wires. On the paper side transverse wires of 0.17 mm diameter are used, while on the running side polyester and polyamide wires alternate, both of a diameter of 0.22 mm.

Figure 8A:
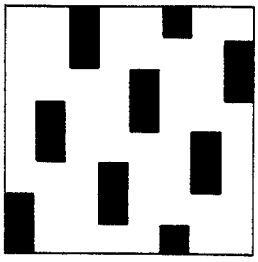
FIG. 8A shows in schematic fashion the weave pattern on the paper side of a further double-layer fabric in accordance with the principles of the present invention.
Figure 8B:
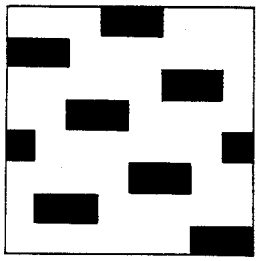
FIG. 8B shows in schematic fashion the weave pattern on the running side of the double-layer fabric of FIG. 8A.

FIG. 8A shows the weave of the paper side of this screen;

FIG. 8B shows the weave on the running side; and

Figure 8C:
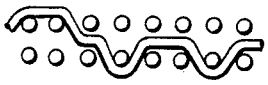
FIG. 8C illustrates the course of the longitudinal wire in the double-layer fabric of FIGS. 8A and 8B.

FIG. 8C shows the course of the longitudinal wires.

EXAMPLE 3

The successive longitudinal wires are passed in pairs alternately through the top and through the bottom layer while they take different courses over the remaining length thereof, i.e. outside these knuckle points.

The selected weave is an 11-harness weave. The type of longitudinal wires is the same, namely 62 longitudinal wires per centimeter having a diameter of 0.17 mm each. The transverse wires of the top layer have a diameter of 0.17 mm and are all made of polyester. The transverse wires of the bottom layer have a diameter of 0.24 mm and are alternately of polyester and polyamide.

Figure 9A:
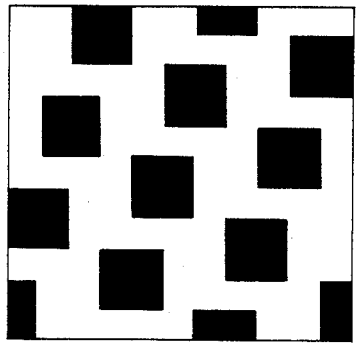
FIG. 9A illustrates in schematic fashion the weave pattern on the top side of yet a further double-layer fabric in accordance with the principles of the present invention.
Figure 9B:
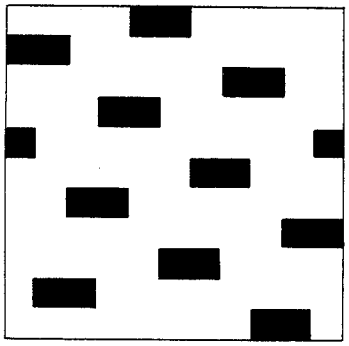
FIG. 9B illustrates in schematic fashion the weave pattern on the bottom side of the double-layer fabric of FIG. 9A.

FIG. 9A shows the weave of the top side;

FIG. 9B shows the weave of the bottom side; and

Figure 9C:
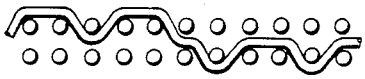
FIG. 9C shows the course of the longitudinal wire in the double-layer fabric of FIGS. 9A and 9B.

FIG. 9C shows the course of the longitudinal wires.

EXAMPLE 4

In contrast to the preceding three examples, in this example two longitudinal wires each extend pair-wise in parallel along their entire length.

The longitudinal wire density is again 62 per centimeter. The wires are polyester monofilaments of 0.17 mm diameter.

The transverse wires of the top layer have a diameter of 0.17 mm.

In the bottom layer the transverse wires have a diameter of 0.26 mm; the material is alternately polyester and polyamide.

Figure 10A:
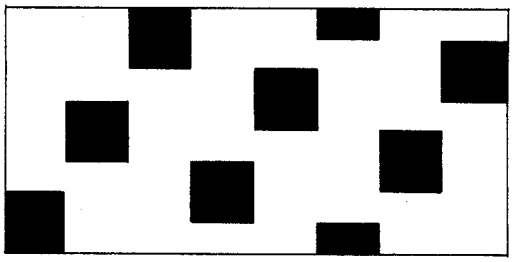
FIG. 10A illustrates in schematic fashion the weave pattern of the top layer of still a further double-layer fabric in accordance with the principles of the present invention.
Figure 10C:
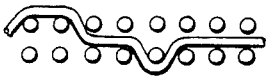
FIG. 10C shows the course of the longitudinal wire of the double-layer fabric of FIGS. 10A and 10B.
Figure 10B:
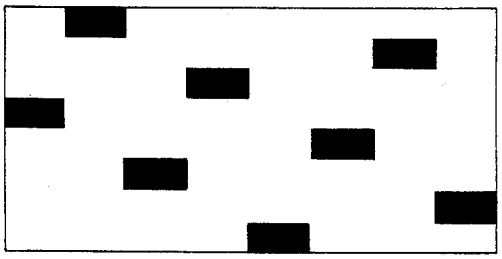
FIG. 10B illustrates in schematic fashion the weave pattern of the bottom layer of the double-layer fabric of FIG. 10A.

FIG. 10A shows the weave of the top layer;

FIG. 10B shows the weave of the bottom layer; and

FIG. 10C shows the course of a longitudinal wire.

What is claimed is:

1. A paper machine forming fabric comprising a double layer woven fabric, said fabric having longitudinally extending warp wires and two layers of transversely extending weft wires, at least part of the warp wires being interwoven with the weft wires of both said layers, said fabric being characterized in that said warp wires are passed pair-wise in parallel over at least two weft wires on the paper side of the fabric and in that, in the fabric interior, said warp wires of each pair extend at an angle with respect to each other, and form an opening in the transverse direction.

2. A paper machine forming in accordance with claim 1 further characterized in that each warp wire in the top of said layers passes over two weft wires at least twice per repeat length, the first time together with the preceding warp wire and the second time together with the succeeding warp wire.

3. A paper machine forming fabric in accordance with claim 1 further characterized in that two adjacent warp wires each join in the bottom of said layers in passing about two non-successive weft wires.

* * * * *